US010385814B2

(12) United States Patent
Sgatti et al.

(10) Patent No.: US 10,385,814 B2
(45) Date of Patent: Aug. 20, 2019

(54) METHOD FOR REFRESHING THE INJECTION LAW OF A FUEL INJECTOR

(71) Applicant: Magneti Marelli S.p.A., Corbetta (IT)

(72) Inventors: Stefano Sgatti, Imola (IT); Marco Parotto, Bologna (IT); Gabriele Serra, S. Lazzaro di Savena (IT); Fabio Sensi, Casalecchio di Reno (IT)

(73) Assignee: Magneti Marelli S.p.A., Corbetta (IT)

( * ) Notice: Subject to any disclaimer, the term of this patent is extended or adjusted under 35 U.S.C. 154(b) by 1205 days.

(21) Appl. No.: 13/911,244

(22) Filed: Jun. 6, 2013

(65) Prior Publication Data

US 2013/0327297 A1 Dec. 12, 2013

(30) Foreign Application Priority Data

Jun. 6, 2012 (IT) ..... BO2012A0310

(51) Int. Cl.

| | |
|---|---|
| ***F02M 69/50*** | (2006.01) |
| ***F02D 41/24*** | (2006.01) |
| *F02B 75/18* | (2006.01) |
| *F02D 41/40* | (2006.01) |

(52) U.S. Cl.

CPC ..... *F02M 69/50* (2013.01); *F02D 41/247* (2013.01); *F02D 41/2467* (2013.01); *F02B 2075/1808* (2013.01); *F02D 41/402* (2013.01); *F02D 2200/0602* (2013.01); *F02D 2200/0616* (2013.01)

(58) Field of Classification Search

CPC ..... F02B 2075/1808; F02D 2200/0602; F02D 41/247; F02D 41/2467; F02D 41/402; F02D 2200/0616; F02M 69/50

USPC ..... 123/456, 478; 701/101, 102, 104

See application file for complete search history.

(56) References Cited

U.S. PATENT DOCUMENTS 4,785,784 A * 11/1988 Nanyoshi ..... F02D 41/04 123/478
5,176,122 A * 1/1993 Ito ..... F02D 41/2438 123/447
6,655,337 B2 * 12/2003 Hirano ..... F02B 75/22 123/184.31

(Continued)

FOREIGN PATENT DOCUMENTS

EP 0488362 A2 6/1992
EP 1026384 A1 * 8/2000 ..... F02D 41/2435

(Continued)

*Primary Examiner* — Mahmoud Gimie
*Assistant Examiner* — Joshua Campbell
(74) *Attorney, Agent, or Firm* — Howard & Howard Attorneys PLLC

(57) ABSTRACT

A method refreshes an injection law of a fuel injector to be tested in an injection system. The method comprises steps of establishing a desired fuel quantity for the fuel injector to be tested, performing at least one first measurement opening of the fuel injector to be tested in a test actuation time, determining a pressure drop in a common rail during the first measurement opening of the fuel injector to be tested, determining a first fuel quantity that is fed during the first measurement opening, calculating a second fuel quantity as a difference between the desired fuel quantity and the first fuel quantity, and performing a second completion opening of the fuel injector to be tested for feeding the second fuel quantity needed to reach the desired fuel quantity.

9 Claims, 2 Drawing Sheets

(56) References Cited

U.S. PATENT DOCUMENTS

Figure 1:
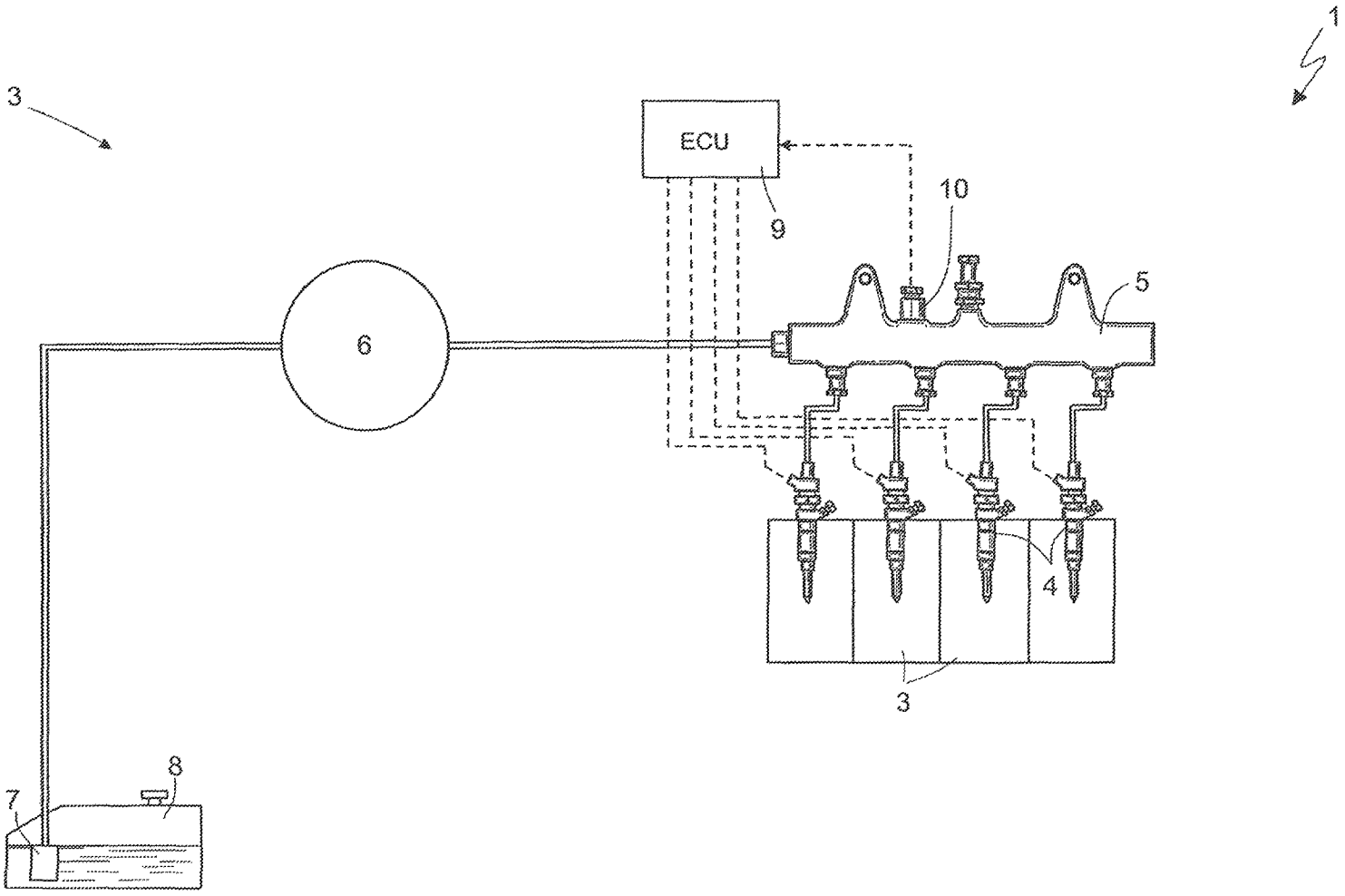

| | | | | |
|---|---|---|---|---|
| 2004/0107944 | A1* | 6/2004 | Yomogida | F02D 41/3836 123/458 |
| 2006/0107936 | A1 | 5/2006 | Mazet | |
| 2009/0164086 | A1* | 6/2009 | Geveci | F02D 41/2438 701/102 |
| 2009/0177366 | A1* | 7/2009 | Achleitner | F02D 41/0087 701/103 |
| 2009/0292447 | A1* | 11/2009 | Yamaguchi | F02D 35/023 701/103 |
| 2012/0123703 | A1* | 5/2012 | Serra | F02D 41/2432 702/47 |

FOREIGN PATENT DOCUMENTS

| | | | | |
|---|---|---|---|---|
| EP | 1854987 | A2 | 11/2007 | |
| EP | 2455605 | A1 * | 11/2010 | |
| EP | 2453123 | A1 | 5/2012 | |
| EP | 2453124 | A1 | 5/2012 | |
| EP | 2455605 | A1 * | 5/2012 | F02D 41/221 |
| EP | 2455605 | A1 * | 5/2012 | F02D 41/221 |

* cited by examiner

METHOD FOR REFRESHING THE INJECTION LAW OF A FUEL INJECTOR

REFERENCE TO RELATED APPLICATION

This application is based upon and claims priority to Italian Patent Application BO2012A 000310 filed on Jun. 6, 2012.

BACKGROUND OF INVENTION

1. Field of Invention

The invention relates to a method for refreshing the injection law of a fuel injector [i.e., for refreshing the law that binds the actuation time (i.e., the driving time) to the injected-fuel quantity].

2. Description of Related Art

Patent Application EP2455605A1 suggests a method for determining the actual injection law of a fuel injector to be tested. The method includes the steps of: interrupting the feeding of fuel from the fuel pump to a common rail; avoiding the opening of all fuel injectors, except for the fuel injector to be tested; measuring the initial fuel pressure inside the common rail before starting the opening of the fuel injector to be tested; opening the fuel injector to be tested for a number of consecutive openings greater than one with a same test actuation time; measuring the final fuel pressure inside the common rail after ending the opening of the fuel injector to be tested; and estimating as a function of a pressure drop in the common rail the fuel quantity that is actually injected by the fuel injector to be tested when it is opened for the test actuation time.

Patent Application EP0488362A1 and Patent Application US2006107936A1 suggest methods for refreshing the actual injection law of a fuel injector to be tested.

As described in Patent Application EP2455605A1, during the normal operation of the internal-combustion engine, an electronic-control unit determines the required fuel quantity for each fuel injector as a function of the objectives of the engine-control unit and, thus, determines the desired actuation time for each fuel injector as a function of the desired fuel quantity by using the injection law stored in the electronic-control unit itself. In normal conditions, each fuel injector would be actuated using exactly the desired actuation time. Instead, for estimating, the electronic-control unit compares each test actuation time with the desired actuation time to establish whether at least one test actuation time is compatible with the desired actuation time and, thus, estimates the fuel quantity that is actually injected by the fuel injector when it is opened for a test actuation time if such a test actuation time is compatible with the desired actuation time.

A test actuation time is compatible with the desired actuation time if the fuel quantity injected with test actuation time is equal to a whole sub-multiple of the desired fuel quantity injected with the desired actuation time minus a "tolerance" interval [i.e., if the fuel quantity injected in the test actuation time multiplied by a whole number (including number 1) (i.e., the test actuation time may be identical to the desired actuation time) is equal to the desired fuel quantity injected in the desired actuation time minus a "tolerance" interval (it is evidently very difficult to obtain perfect equality without allowing a minor difference)].

After having identified a test actuation time (minus the "tolerance" interval) compatible with the desired actuation time, the electronic-control unit modifies the desired fuel quantity required by the electronic-control unit in the "tolerance" interval so that the average fuel quantity corresponding to the test actuation time is exactly a sub-multiple of the desired fuel quantity (obviously, the average fuel quantity corresponding to the test actuation time could be identical to the desired fuel quantity). In other words, to estimate the fuel quantity injected by a fuel injector to be tested using a test actuation time, starting from the desired fuel quantity required by the engine control of the internal-combustion engine, the electronic-control unit may decide to modify ("override") the injection features by varying both the desired fuel quantity (within the "tolerance" interval) and by dividing the injection into several consecutive injections.

However, it has been observed that replacing a single "long" injection (having a duration equal to the desired actuation time), which occurs in a linear operating zone of the fuel, with many consecutive "short" injections (each of which feeds a fuel quantity equal to a sub-multiple of the desired fuel quantity), which occurs in a ballistic operating zone of the fuel injector, may lead to a significant total error of the fuel quantity that is actually injected (i.e., the fuel quantity that is actually injected by the series of "short" injections can be significantly different from the desired fuel quantity) because the injection errors of all the consecutive "short" injections are algebraically summed.

In other words, the error between the normal injection law and the actual injection law is always low when the fuel injector is used in the linear operating zone whereas the error between the nominal injection law and the actual injection law may be even very high when the fuel injector is used in the ballistic operating zone. Above all, at the beginning of the actual injection law of each fuel injector, the actual behavior of the fuel injector in the ballistic operating zone is not known with adequate accuracy. Thus, replacing single operation in the linear operating zone with multiple operation in the ballistic operating zone may imply very high errors in the injected-fuel quantity with major repercussions on the operating smoothness of the internal-combustion engine.

It is an object of the invention to provide a method for refreshing the injection law of a fuel injector, which method is free from the above-described drawbacks and, in particular, easy and cost-effective to implement and allows avoidance in any situation operating irregularities of the internal-combustion engine.

SUMMARY OF INVENTION

The invention overcomes the drawbacks in the related art in a method for refreshing an injection law of a fuel injector to be tested in an injection system. The method comprises steps of establishing a desired fuel quantity for the fuel injector to be tested, performing at least one first measurement opening of the fuel injector to be tested in a test actuation time, determining a pressure drop in a common rail during the first measurement opening of the fuel injector to be tested, determining a first fuel quantity that is fed during the first measurement opening, calculating a second fuel quantity as a difference between the desired fuel quantity and the first fuel quantity, and performing a second completion opening of the fuel injector to be tested for feeding the second fuel quantity needed to reach the desired fuel quantity.

Objects, features, and advantages of the method of the invention are readily appreciated as the method becomes more understood while the subsequent detailed description of at least one non-limiting embodiment of the method is read taken in conjunction with the accompanying drawing thereof.

BRIEF DESCRIPTION OF EACH FIGURE OF DRAWING

Figure 2:
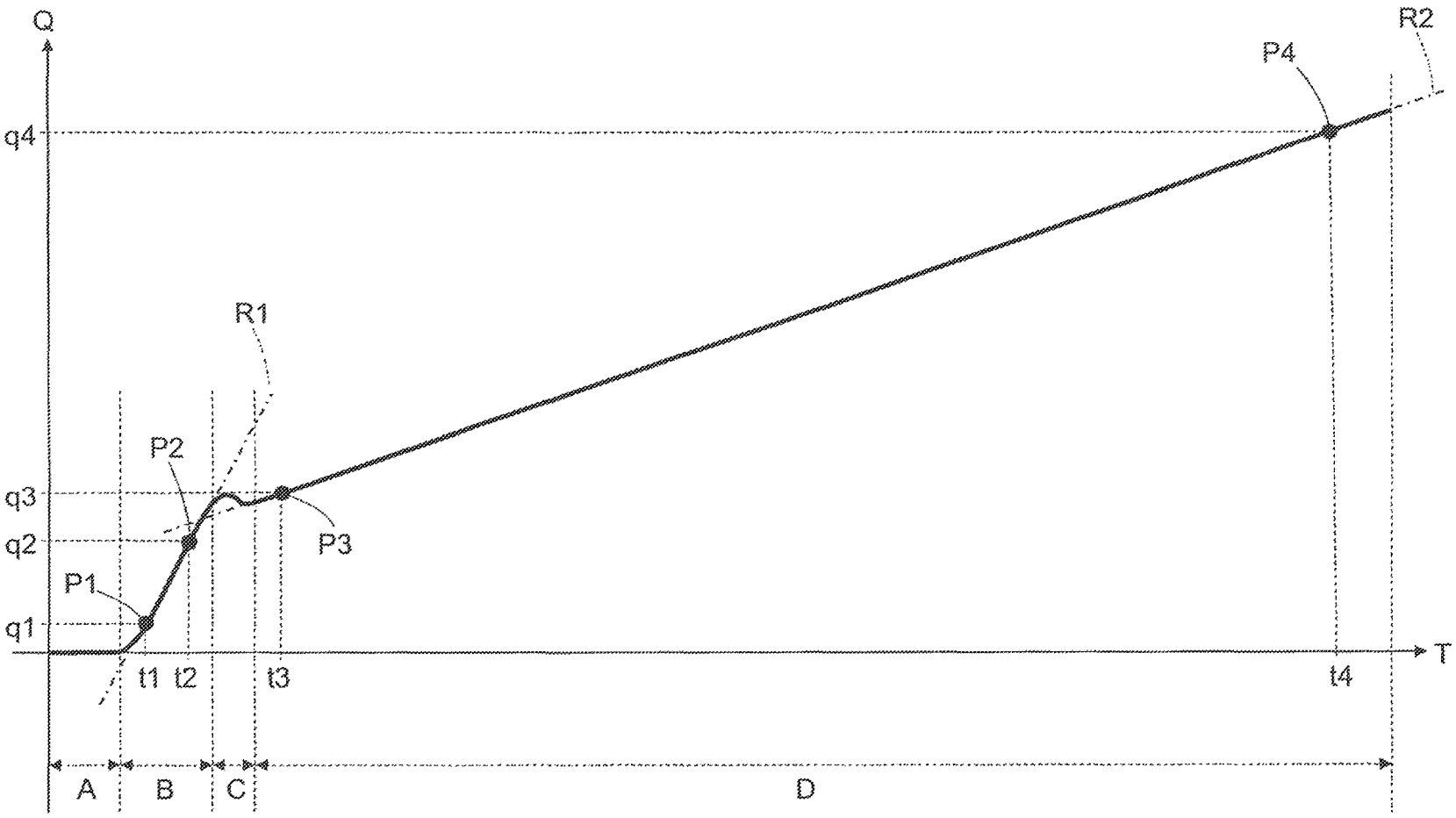

FIG. 1 is a diagrammatic view of an internal-combustion engine provided with a common rail-type injection system in which the method for refreshing the injection law of the injectors of the invention is applied; and FIG. 2 is a chart illustrating the injection law of an electromagnetic fuel injector of the injection system in FIG. 1.

DETAILED DESCRIPTION OF EMBODIMENT(S) OF INVENTION

In FIG. 1, an internal-combustion engine is generally indicated at 1 and provided with four cylinders 2 and a common rail-type injection system 3 for direct injection of fuel into the cylinders 2 themselves. The injection system 3 includes four electromagnetic fuel injectors 4 each of which injects fuel directly into a respective cylinder 2 of the engine 1 and receives pressurized fuel from a common rail 5 (for example, each fuel injector 4 is made as described in Patent Application EP2455605A1). The injection system 3 includes a high-pressure pump 6, which feeds fuel to the common rail 5 and is actuated directly by a driving shaft of the internal-combustion engine 1 by a mechanical transmission the actuation frequency of which is directly proportional to the rotation speed of the driving shaft. In turn, the high-pressure pump 6 is fed by a low-pressure pump 7 arranged within the fuel tank 8.

Each fuel injector 4 injects a variable fuel quantity into the corresponding cylinder 2 under the control of an electronic-control unit (ECU) 9. The common rail 5 is provided with a pressure sensor 10, which measures the fuel pressure P in the common rail 5 itself and communicates with the electronic-control unit 9.

As shown in FIG. 2, the injection law [i.e., the law that binds the actuation time T to the injected-fuel quantity Q (represented by the actuation time T–injected-fuel quantity Q)] of each fuel injector 4 can be approximated by a straight line R1 (which approximates a ballistic operating zone B) and a straight line R2 (which approximates a linear operating zone D and intersects the straight line R1). The straight line R1 is identified by two characteristic points P1, P2 arranged on the ends of the ballistic operation area B, and the straight line R2 is identified by two characteristic points P3, P4 arranged at the ends of the linear operation area C. Each of the characteristic points P1-P4 has a corresponding characteristic actuation time t1-t4 and a corresponding injected-fuel quantity q1-q4, and the characteristic points P1-P4 as a whole allow to reconstruct an adequate confidence of the injection law of a fuel injector 4.

Obviously, other embodiments that use a different number of characteristic points and/or a different distribution of characteristic points are possible. Alternatively, further embodiments that do not use straight lines to approximate the injection law are possible (e.g., "spline" functions could be used). According to a possible embodiment, the nominal injection law is maintained in the linear operating zone D (or at least in the terminal part at the longer actuation time T) while an actuation injection law is reconstructed knowing some characteristic points P1-Pn only in ballistic operating zone B and replaces (i.e., refreshes) the nominal injection law.

According to a possible embodiment, the actual injection law (i.e., the characteristic points P1-Pn that define the actual injection law) is variable as a function of the fuel pressure P in the common rail 5. In other words, each characteristic point P1-Pn that defines the actuation injection law is determined at different fuel pressures P.

The nominal injection law of each fuel injector 4 is initially stored in a memory of the electronic-control unit 9. In use, the electronic-control unit 9 determines the desired fuel quantity Qd for each fuel injector 4 as a function of the engine-control objectives and, thus, determines the desired actuation time Td for each fuel injector 4 as a function of the desired fuel quantity Qd using the previously stored injection law.

The electronic-control unit 9 determines the actual injection laws of the fuel injectors 4 during normal use of the internal-combustion engine 1. Determining the actual injection law of a fuel injector 4 to be tested means determining the characteristic points P1-P4 of the injection law (i.e., determining the fuel quantity Q that is actually injected by the fuel injector 4 to be tested when it is opened for a test actuation time T equal to the corresponding characteristic actuation time t1-t4 for each characteristic point P1-P4).

For each fuel injector 4 to be tested and for each actuation test time T, the determination of the fuel quantity Q that is actually injected by the fuel injector 4 to be tested when it is opened for the test actuation time T includes completely interrupting the fuel feeding from the fuel pump 6 to the common rail 5, avoiding the opening of all the other fuel injectors 4 besides the fuel injector 4 to be tested, and measuring the initial fuel pressure Pi in the common rail 5 before starting the opening of the fuel injector 4 to be tested by the pressure sensor 10. After having measured the initial fuel pressure Pi, the electronic-control unit 9 opens the fuel injector 4 to be tested for a number $N_{inj}$ of consecutive (injected) openings with the same test actuation time T. The final fuel pressure Pf in the common rail 5 is measured by the pressure sensor 10 after having ended the opening of the fuel injector 4 to be tested. The electronic-control unit 9 determines a pressure drop ΔP in the common rail 5 during the opening of the fuel injector 4 to be tested (equal to the difference between the initial fuel pressure Pi and the final fuel pressure Pf). Finally, the electronic-control unit 9 estimates the fuel quantity that is actually injected by the fuel injector 4 to be tested when it is opened for the test actuation time T.

After having obtained the pressure drop ΔP in the common rail 5, the electronic-control unit 9 estimates the total fuel quantity $Q_{TOT}$ that was actually injected by the fuel injector 4 during the openings with the test actuation time T itself as a function of the pressure drop ΔP in the common rail 5 [thus, calculating the fuel quantity $Q_{TOT}$ that is actually injected by the fuel injector 4 to be tested when it is opened for the test actuation time T by dividing the total fuel quantity by the number N of openings (i.e., [1]$Q=Q_{TOT}/N_{inj}$)].

It is most simply assumed that the total fuel quantity $Q_{TOT}$ that was actually injected by the fuel injector 4 during the openings is equal to the total fuel quantity $Q_{TOT}$ that exited from the common rail 5. The dependence between the total fuel quantity $Q_{TOT}$ that exited from the common rail 5 and the pressure drop ΔP in the common rail 5 can be determined by calculations or experimentally once the volume inside the common rail 5 and the "compressibility" modulus of the fuel are known. According to an embodiment, there is a direct linear ratio between the pressure drop ΔP in the common rail 5 and the total fuel quantity $Q_{TOT}$ that exited from the common rail 5 (i.e., [2]$Q_{TOT}$=ΔP*K).

The proportional constant K depends on the volume inside the common rail 5 and the "fuel compressibility" modulus and may be determined either by calculations or empirically. The "compressibility" modulus may vary (slightly) with the fuel temperature and type, and it is, thus, possible to determine the value of the proportional constant K at different fuel temperatures and/or with different types of fuel either by calculations or empirically.

In brief, to estimate the fuel quantity Q that is actually injected by the fuel injector 4 to be tested when it is opened for a test actuation time T, the electronic-control unit 9 completely interrupts the feeding of fuel from the fuel pump 6 to the common rail 5, avoids the opening of all the fuel injectors 4 (except for the fuel injector 4 to be tested), measures (after having waited for a first predetermined interval of time) the initial pressure Pi of the fuel in the common rail 5 before starting the opening of the fuel injector 4 to be tested, opens the fuel injector 4 to be tested for a number of consecutive openings $N_{inj}$ for the same test actuation time T, and finally measures the final pressure Pf of the fuel in the common rail 5 after having ended the opening of the fuel injector 4 to be tested (after having waited for a second predetermined interval of time). At the end of the two pressure measurements, the electronic-control unit 9 determines the pressure drop ΔP in the common rail 5 during the opening of the fuel injector 4 to be tested and, thus, estimates the fuel quantity Q that is actually injected by the fuel injector 4 to be tested when it is opened for the test actuation time T as a function of the pressure drop ΔP in the common rail 5.

As described above, the actuation times T are chosen from a whole of the characteristic actuation times t1, t2, t3, t4 to determine the characteristic points P1-P4 and, thus, reconstruct the actual injection law of each fuel injector 4 by the two straight lines R1, R2.

It is worth noting that an estimate of the fuel quantity Q concerns only one fuel injector 4 to be tested at a time while the other three fuel injectors 4 work normally in the same injection cycle. Obviously, during the estimate of the fuel quantity Q that is actually injected by the fuel injector 4 to be tested when it is opened for the test actuation time T, the other three fuel injectors 4 absolutely must be closed. But, this indispensable condition is not limitative because, in an internal-combustion engine 1 with four cylinders 3, the four fuel injectors 4 always inject at different times (each in a corresponding half-revolution of the driving shaft to have four injections every two revolutions of the driving shaft), and, consequently (other than for exceptional cases), the overlapping of the two fuel injectors 4 injecting at the same time never occurs.

During the normal operation of the internal-combustion engine 1, it is not possible to inject a fuel quantity significantly different from the optimal fuel quantity for the "motion" needs of the internal-combustion engine 1. Otherwise, the internal-combustion engine 1 would manifest operating irregularities that are not acceptable (the driver of the vehicle 14 would perceive such operating irregularities as a fault or, even worse, a manufacturing defect). In other words, the fuel that is injected must firstly comply with the "motion" needs of the internal-combustion engine 1 and only later respond to the needs of determining the actual injection of the fuel injectors 4.

The first consequence with respect to the "motion" needs of the internal-combustion engine 1 is that it is possible to perform a very limited number $N_{inj}$ of consecutive openings of the fuel injector 4 to be tested with the same test actuation time (no more than 5-8 consecutive openings when the test actuation time is short and no more than one actuation when the test actuation time is long) in each measurement (i.e., in each observation). When the number $N_{inj}$ of consecutive openings of the fuel injector 4 to be tested with the same test actuation time is small, the pressure drop ΔP in the common rail 5 during the opening of the fuel injector 4 to be tested is reduced, and, thus, its determination is less accurate (because the order of size of pressure drop ΔP is comparable to the size of the errors of the pressure sensor 10, the hydraulic and electric background noise, and the minimum resolution at which the electronic-control unit 9 reads the output of the pressure sensor 10). Because the pressure drop ΔP in the common rail 5 during the opening of the fuel injector 4 to be tested is marred by considerable errors, a high number (in the order of hundreds) of measurements of the pressure drop ΔP in the common rail 5 during the opening of the fuel injector 4 to be tested for the test actuation time T must be performed. Only having a high number of measurements of the pressure drop ΔP in the common rail 5 for the same test actuation time T is it possible to calculate an average pressure drop $\Delta P_{average}$ with acceptable accuracy, and it is, thus, possible to determine the fuel quantity Q that is actually injected by the fuel injector 4 to be tested when the test actuation time T is opened with equally acceptable accuracy and as a function of the average pressure drop $\Delta P_{average}$.

Consequently, during normal use of the internal-combustion engine 1, the electronic-control unit 9 performed [over a long period of time (i.e., during hours of operation of the internal-combustion engine 1)] a series (in the order of thousands) of measurements of the pressure drops ΔP in the common rail 5 for each test actuation time T, and, thus, the electronic-control unit 9 statistically processes the series of measurements of the pressure drop ΔP in the common rail 5 for each test actuation time itself T to determine an average pressure drop $\Delta P_{average}$. For each actuation time T and using the average pressure drop $\Delta P_{average}$, the electronic-control unit 9 estimates the corresponding fuel quantity Q that is actually injected by the fuel injector 4 to be tested when it is opened for the test actuation time T that allows for identification of the characteristic point P1-P4 of the actual injection law of the fuel injector 4.

In use, the electronic-control unit 9 determines the desired fuel quantity Qd for each fuel injector 4 as a function of the engine-control objectives and, thus, determines the desired actuation time Td for each fuel injector 4 as a function of the desired fuel quantity Qd using the injection law stored in a memory thereof [which is initially the nominal injection law and gradually corrected (i.e., refreshed) to gradually converge toward the actual injection law]. Normally, each fuel injector 4 would be driven by using exactly the desired actuation time Td [i.e., would be open with a single opening (injection) having a duration equal to the desired actuation time]. Instead, for measuring the pressure drop ΔP in the common rail 5, the electronic-control unit 9 initially performs at least one first opening (injection) having a duration equal to a test actuation time T (chosen from the set of characteristic actuation times t1, t2, t3, t4 corresponding to the characteristic points P1-P4) and, thus, performs (immediately after) a single completion opening (injection) that feeds the fuel quantity needed to reach the required fuel quantity Qd exactly.

In other words, having determined the desired actuation time Td for each injector as a function of the desired fuel quantity Qd, the electronic-control unit 9 chooses (from the set of characteristic actuation times t1, t2, t3, t4 corresponding to the characteristic points P1-P4) a test actuation time T compatible with the desired actuation time Td to measure the pressure drop ΔP in the common rail 5 [thus, initially performing at least one first measurement opening (injection) having a duration equal to the test actuation time T] and then performs (immediately after the first measurement opening) a second completion opening (injection) that feeds the fuel quantity needed to exactly reach the desired fuel quantity Qd. Thus, the electronic-control unit 9 estimates a first fuel quantity Q1 that is fed in total during the first measurement opening (injection) and calculates a second fuel quantity Q2 that must be fed during the second completion opening (injection) between the desired fuel quantity Qd and the first fuel quantity Q1 (i.e., [3]Q2=Qd−Q1).

The first fuel quantity Q1 is fed in total during the first measurement opening (injection), which is calculated as a function of the test actuation time T and of the number $N_{inj}$ of first measurement openings (injections) performed and using the current injection law (i.e., the injection law that is normally used for controlling the fuel injectors 4). To calculate the first fuel quantity Q1, the first pressure drop ΔP in the common rail 5 during the opening of the fuel injector 4 to be tested is not used for the test actuation time T because such a pressure drop ΔP may be marred by very high errors with respect to the current injection law (such errors "disappear" when a high number of pressure drops ΔP are statically processed, but are entirely present considering a single pressure drop ΔP).

A completion actuation time T2 that is used to perform the second completion opening (injection) is determined as a function of the second fuel quantity Q2. In other words, the fuel injector 4 is opened for the completion actuation time T2 to inject the second fuel quantity Q2 during the second completion opening (injection). The completion actuation time T2 is determined as a function of the second fuel quantity Q2 and using the current injection law (i.e., the injection law that is normally used to control the fuel injectors 4).

It is worth noting that the electronic-control unit 9 performs at least one first measurement opening (injection) and may, thus, perform a number $N_{inj}$ of first measurement opening (injections) higher than one with the same test actuation time T (obviously, it is easier to perform several consecutive measurement openings for shorter test actuation times T).

A test actuation time T is compatible with the desired actuation time Td if the injected-fuel quantity Q (or a whole multiple of the injected-fuel quantity Q) using test actuation time T is adequately lower than the desired injected-fuel quantity Qd using the desired actuation time Td [i.e., if the difference between the desired quantity of fuel Qd and the injected-fuel quantity Q (or whole multiples of the injected-fuel quantity Q) using the test actuation time T is adequately large to allow performance of the second completion opening (injection) with adequate accuracy]. Typically, the second completion opening (injection) may be performed with adequate accuracy if the second completion opening (injection) falls within the linear operating zone D of the fuel injector 4 (i.e., in the operating zone in which the errors between the nominal injection law and the actual injection law are always low).

As previously mentioned, by increasing the number of measurements performed for each test actuation time T (i.e., for each characteristic actuation time t1, t2, t3, t4 corresponding to a characteristic point P1-P4), it is possible to refresh (correct) the injection law of the fuel injectors 4 with ever-increasing accuracy, particularly in the ballistic operating zone B, thus gradually increasing the "injection" confidence of the injection law stored in the electronic-control unit 9. According to a possible embodiment, the number of first consecutive measurement openings (injections) performed for the number $N_{inj}$ of first consecutive measurement openings (injections) with the same test actuation time T also increases as the "stored injection law" confidence increases (i.e., as the number of performed measurements increase for a test actuation time T). In other words, initially (when the electronic-control unit 9 has a few measurements available), the number $N_{inj}$ of first measurement openings (injections) with the same test actuation time T is very low [often equal to one (i.e., a single first measurement opening)]. Afterward (when the electronic-control unit 9 has many measurements available), the number $N_{inj}$ of first measurement openings (injections) with the same test actuation time is gradually increased.

The above-described method for determining the injection law of a fuel injector 4 has many advantages. Firstly, the method allows for assurance of high operating smoothness of the internal-combustion engine 1 because the fuel quantity fed with adequate accuracy by the second completion opening (injection) occurs in the linear operating zone of the fuel injector 4 for each measurement of the pressure drop ΔP associated to a test actuation time T. Furthermore, the method allows for very frequent measurement of the pressure drop ΔP associated to a test actuation time T (possibly even at each fuel injection) because measuring the pressure drop ΔP does not significantly damage the operating smoothness of the internal-combustion engine 1. Finally, the method is simple and cost-effective to implement also in an existing electronic-control unit because no additional hardware is needed with respect to that normally present in the fuel-injection systems, and neither high calculation power nor large memory capacity is needed.

It should be appreciated by those having ordinary skill in the related art that the method has been described above in an illustrative manner. It should be so appreciated also that the terminology that has been used above is intended to be in the nature of words of description rather than of limitation. It should be so appreciated also that many modifications and variations of the method are possible in light of the above teachings. It should be so appreciated also that, within the scope of the appended claims, the method may be practiced other than as specifically described above.

What is claimed is:

1. A method for refreshing an injection law of a fuel injector (4) under test in an injection system (3) that includes a plurality of fuel injectors (4), a common rail (5) feeding fuel under pressure to the fuel injectors (4), and a fuel pump (6) that keeps the fuel under pressure inside the common rail (5);

the method comprising the steps of:

approximating the injection law, which binds an actuation time (T) of an actuator of the fuel injector (4) under test to an injected-fuel quantity (Q), by using a plurality of characteristic points (P1, P2, P3, P4) each of which has a corresponding characteristic actuation time (t1, t2, t3, t4) and a corresponding injected-fuel quantity (q1, q2, q3, q4);

determining a desired fuel quantity (Qd) for the fuel injector (4) under test as a function of objectives of an engine-control unit of an internal-combustion engine (1) incorporating the injection system (3) so that the desired fuel quantity (Qd) is the optimal fuel quantity for the motion needs of the internal-combustion engine (1) incorporating the injection system (3);

determining a desired actuation time (Td) for the fuel injector (4) under test as a function of the desired fuel quantity (Qd) and using the injection law;

completely interrupting the feeding of the fuel from the fuel pump (6) to the common rail (5);

avoiding opening of all of the fuel injectors (4), except for the fuel injector (4) under test;

measuring an initial fuel pressure (Pi) inside the common rail (5) before starting the opening of the fuel injector (4) under test;

choosing, from the characteristic actuation times (t1, t2, t3, t4), a test actuation time (T) that is adequately lower than the desired actuation time (Qd) necessary to inject the desired fuel quantity (Qd) so that a first fuel quantity (Q1) injected in total by opening the fuel injector (4) under test with the test actuation time (T) is lower than the desired fuel quantity (Qd) and so that the difference between the desired quantity of fuel (Qd) and the first fuel quantity (Q1) is adequately large to allow being injected by the fuel injector (4) under test;

performing at least one first measurement opening of the fuel injector (4) under test with the test actuation time (T) to inject as a whole the first fuel quantity (Q1) lower than the desired fuel quantity (Qd);

measuring a final fuel pressure (Pf) inside the common rail (5) after having ended the first measurement opening of the fuel injector (4) under test;

determining a pressure drop (ΔP) in the common rail (5) during the first measurement opening of the fuel injector (4) under test that is equal to a difference between the initial fuel pressure (Pi) and the final fuel pressure (Pf);

estimating, as a function of the pressure drop (ΔP) in the common rail (5),the first fuel quantity (Q1) that is actually injected by the fuel injector (4) under test when the fuel injector (4) is opened for the test actuation time (T) that is fed in total during the first measurement opening;

calculating a second fuel quantity (Q2) as a difference between the desired fuel quantity (Qd) and the first fuel quantity (Q1);

determining a completion actuation time (T2) as a function of the second fuel quantity (Q2) and using the injection law; and performing, immediately after the first measurement opening, a single second completion opening of the fuel injector (4) under test with the completion actuation time (T2) to feed the second fuel quantity (Q2), which is necessary to reach the desired fuel quantity (Qd).

2. The method according to claim 1, wherein the method further comprises the step of performing a number ($N_{inj}$) of consecutive ones of the first measurement opening of the fuel injector (4) under test using the same test actuation time (T).

3. The method according to claim 2, wherein the method further comprises the step of increasing the number ($N_{inj}$) of the consecutive ones of the first measurement opening of the fuel injector (4) under test using the same test actuation time (T) as confidence in an injection law stored in a memory of the engine-control unit (9) increases.

4. The method according to claim 2, wherein the method further comprises the step of increasing the number ($N_{inj}$) of the consecutive ones of the first measurement opening of the fuel injector (4) under test using the same test actuation time (T) as a number of measurements of the pressure drop (ΔP) in the common rail (5) performed increases.

5. The method according to claim 1, wherein:

the injection law is approximated by a first straight line (R1) approximating a ballistic operating zone (B) and by a second straight line (R2) approximating a linear operating zone (D) and intersecting the first straight line (R1); and the test actuation time (T) is chosen so that the second fuel quantity (Q2) falls within the second straight line (R2) approximating the linear operating range (D) of the fuel injector (4) under test.

6. The method according to claim 1, wherein the method further comprises the steps of:

performing a series of measurements of the pressure drop (ΔP) in the common rail (5) during the corresponding first measurement openings of the fuel injector (4) under test using the same test actuation time (T) while the feeding of the fuel from the fuel pump (6) to the common rail (5) has been completely interrupted and the opening of all of the fuel injectors (4), except for the fuel injector (4) under test, has been avoided;

calculating an average pressure drop ($\Delta P_{average}$) by a moving average of the series of measurements of the pressure drop (ΔP); and estimating the fuel quantity (Q) that is actually injected by the fuel injector (4) under test when the fuel injector (4) is opened for the test actuation time (T) as a function of the average pressure drop ($\Delta P_{average}$).

7. The method according to claim 1, wherein the step of estimating the fuel quantity (Q) that is actually injected by the fuel injector (4) under test further includes the steps of:

estimating a total fuel quantity ($Q_{TOT}$) that is actually injected by the fuel injector (4) under test during the openings with the same test actuation time (T) as a function of an average pressure drop ($\Delta P_{average}$) in the common rail (5); and calculating the fuel quantity (Q) that is actually injected by the fuel injector (4) under test when the fuel injector (4) is opened for the test actuation time (T) by dividing the total fuel quantity ($Q_{TOT}$) by a number (N) of openings.

8. The method according to claim 1, wherein the first fuel quantity (Q1) is calculated as a function of the test actuation time (T) and a number ($N_{inj}$) of ones of the first measurement opening and performed using the injection law.

9. The method according to claim 1 and comprising the further steps of:

approximating the injection law, which binds the actuation time (T) to the injected-fuel quantity (Q), by a first straight line (R1) approximating a ballistic operating zone (B) and by a second straight line (R2) approximating a linear operating zone (D) and intersecting the first straight line (R1);

identifying the first straight line (R1) by a first and a second characteristic points (P1, P2), which are arranged on the ends of the ballistic operation area (B) and each of which has a corresponding characteristic actuation time (t1, t2) and a corresponding injected-fuel quantity (q1, q2); and identifying the second straight line (R2) by a third and a fourth characteristic points (P3, P4), which are arranged at the ends of the linear operation area (D) and each of which has a corresponding characteristic actuation time (t3, t4) and a corresponding injected-fuel quantity (q3, q4).

* * * * *